US007976203B2

(12) United States Patent
Okada

(10) Patent No.: US 7,976,203 B2
(45) Date of Patent: Jul. 12, 2011

(54) VEHICLE LAMP

(75) Inventor: Hidetaka Okada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 220 days.

(21) Appl. No.: 12/016,672

(22) Filed: Jan. 18, 2008

(65) Prior Publication Data

US 2009/0034277 A1 Feb. 5, 2009

(30) Foreign Application Priority Data

Jan. 18, 2007 (JP) ..... 2007-009579

(51) Int. Cl.
*F21V 1/00* (2006.01)

(52) U.S. Cl. ..... 362/509; 362/498; 362/545; 362/520; 362/521; 362/522

(58) Field of Classification Search ..... 362/509, 362/514, 520, 521, 522, 545, 309, 311.02, 362/332, 333, 498
See application file for complete search history.

(56) References Cited

U.S. PATENT DOCUMENTS 5,373,423 A * 12/1994 Liedtke et al. ..... 362/510
5,748,828 A * 5/1998 Steiner et al. ..... 385/146
6,050,705 A * 4/2000 Kusserow et al. ..... 362/299
6,155,702 A * 12/2000 Blusseau et al. ..... 362/520
6,220,736 B1 * 4/2001 Dobler et al. ..... 362/539
6,855,958 B2 2/2005 Sato et al.
2008/0043481 A1 * 2/2008 Yokoyama et al. ..... 362/465

FOREIGN PATENT DOCUMENTS

JP 2004140090 5/2004
JP 2005183327 7/2005
JP 2005276805 10/2005
JP 2007087946 4/2007
JP 2007123027 5/2007

* cited by examiner

*Primary Examiner* — Evan Dzierzynski
(74) *Attorney, Agent, or Firm* — Kenealy Vaidya LLP

(57) ABSTRACT

A vehicle lamp including a light-emitting semiconductor device can have high visibility even in an area outside of the standard light distribution pattern. The vehicle lamp can include at least one light-emitting semiconductor device and at least one lens that includes both a first lens formation and second lens formation. An optical axis of the at least one lens can correspond with that of the at least one light-emitting semiconductor device. The first lens formation can receive a strong light that is within the range of a half-value angle of light emitted from the at least one light-emitting semiconductor and which forms a standard light distribution pattern. The second lens formation can receive a weak light that is beyond the range of the half-value angle and forms a light distribution pattern in an area outside of the standard light distribution formed by the first lens formation.

23 Claims, 10 Drawing Sheets

VEHICLE LAMP

This application claims the priority benefit under 35 U.S.C. §119 of Japanese Patent Application No. 2007-009579 filed on Jan. 18, 2007, which is hereby incorporated in its entirety by reference.

BACKGROUND

1. Field

The presently disclosed subject matter relates to a vehicle lamp, and more particularly to a vehicle lamp such as a headlight, auxiliary headlight, indicator light, tail light, spot light, traffic light, or other vehicle lamp including a light source using a light-emitting semiconductor device.

2. Description of the Related Art

Recently, various vehicle lamps using an LED as a light source have been devised in accordance with an improvement of luminance efficiency of LEDs. For example, patent document No. 1 (Japanese Patent Application Laid Open JP2001-076513) and patent document No. 2 (Japanese Patent Application Laid Open JP2001-216814) disclose a basic structure of a conventional vehicle lamp using an LED as a light source as shown in FIG. 8.

The vehicle lamp 1 is composed of an LED 2 and an inner lens 3 located in front of the LED 2. The LED 2 is mounted on a circuit board 2*a* and an optical axis O thereof is perpendicular to the circuit board 2*a*. The LED 2 is emitted while being controlled by a driving circuit and virtually operates as a point light source. The inner lens 3 includes a lens formation 3*a* thereon that is configured to form a light distribution pattern so as to conform to a regulation such as a light distribution standard in accordance with traffic laws.

According to the vehicle lamp 1 of the above-described structure, the LED 2 is emitted and driven by a driving circuit. Light emitted from the LED 2 travels forward along the light axis O and illuminates ahead of the lamp in a direction towards the light-emission via the inner lens 3. In this case, the above-described light is illuminated forwards so as to form a predetermined light distribution pattern along with a predetermined light distribution characteristic.

A second structure of a conventional vehicle lamp using an LED as a light source as shown in FIG. 9 is also well known. The structure is disclosed in, for example, patent document No. 3 (Japanese Patent Application Laid Open JP2007-123027). A vehicle lamp 4 shown in FIG. 9 is composed of an LED 2 located so as to emit light in a direction normal to an optical axis of the lamp 4 (an upward direction in FIG. 9) and a reflector 5 located over the LED 2. The LED is mounted on a circuit board 2*a* and the optical axis of the LED 2 is perpendicular to a light-emitting direction of the vehicle lamp 4.

The reflector 5 is configured with a reflector surface that forms an inner surface thereof and forms a concaved shape in a forward direction so as to reflect light emitted from the LED 2 forwards (a rightward direction in FIG. 9). More specifically, the reflector 5 is configured with a parabolic reflector such as a parabola revolving around the optical axis thereof extending in a direction towards the light-emission. A focus of the reflector is located near the light-emitting portion of the LED 2.

According to the vehicle lamp 4 of the above-described structure, the LED 2 is emitted and driven via a driving control by the driving circuit. Light emitted from the LED 2 passes upwards and is reflected by the reflector 5. Therefore, a substantially parallel light is illuminated forward in a direction towards the light-emission direction of the lamp.

Moreover, a third structure of a conventional vehicle lamp using an LED as a light source as shown in FIG. 10 is also well known. The structure is disclosed in, for example, patent document No. 4 (Japanese Patent Application Laid Open JP2005-183327) and patent document No. 5 (Japanese Patent Application Laid Open JP2007-087946). A vehicle lamp 6 shown in FIG. 10 is only composed of an LED 2 mounted on a substrate 2*a* so that an optical axis of the LED 2 extends perpendicular to the substrate 2*a*. In this case, a casing 7 shields sideward directed light emitted from the LED 2 so as not to cause glare.

According to the vehicle lamp 6 of the above-described structure, the LED 2 is emitted and driven by a driving circuit. Light emitted from the LED 2 is directly illuminated forward in a direction towards a light-emission of the vehicle lamp 6. In this case, the vehicle lamp 6 is configured so as to confirm to a predetermined light distribution standard in accordance with traffic laws using the directional characteristics of the LED 2. However, when an outer lens is located in front of the LED 2, the vehicle lamp 6 forms a light distribution pattern in accordance with characteristics of both the LED 2 and the outer lens.

The above-referenced Patent Documents are listed below.

1. Patent document No. 1: Japanese Patent Application Laid Open JP2005-276805
2. Patent document No. 2: Japanese Patent Application Laid Open JP2004-140090
3. Patent document No. 3: Japanese Patent Application Laid Open JP2007-123027
4. Patent document No. 4: Japanese Patent Application Laid Open JP2005-183327
5. Patent document No. 5: Japanese Patent Application Laid Open JP2007-087946

When a vehicle lamp using the above-described structures is devised, some problems, characteristics, and limitations may be caused. For example, when the first exemplary structure shown in FIG. 8 is used for a tail lamp, the tail lamp is required to maintain an illumination intensity that can be seen up to three hundred meters away according to Japanese traffic law. Therefore, the vehicle lamp 1 is required to control light emitted from the LED 2 using the lens formation 3*a* of the lens 3 so as to conform to a light distribution standard.

The vehicle lamp 1 may conform to a light distribution standard using a plurality of LEDs, etc. However, when the vehicle lamp 1 is observed from out of an area of a light distribution pattern formed in accordance with a light distribution standard, the vehicle lamp 1 may have low visibility because of a relatively small amount of light-emission from the LED 2, for instance, in a side view of the vehicle. In addition, because the vehicle lamp 1 includes the lens formation 3*a* in order to conform to a light distribution standard, the vehicle lamp 1 may not be good-looking and may have a pathetic outside appearance and an obsolete design.

In case of the above-described second structure shown in FIG. 9, the vehicle lamp 4 controls light emitted from the LED 2 using the reflex shape of the reflector 5 so as to conform to a light distribution standard. The vehicle lamp 4 may also conform to a light distribution standard using a plurality of LEDs, etc. However, when the vehicle lamp 4 is observed from out of an area of the light distribution pattern formed in accordance with light distribution standards, the vehicle lamp 4 may also have low visibility because of the relatively small amount of light-emission from the LED 2, for instance, in a side view of the vehicle.

When the third exemplary structure shown in FIG. 10 is in, for instance, a headlight, the headlight is required to illuminate up to one hundred meters away at a high beam distribution thereof according to Japanese traffic law. Therefore, the vehicle lamp 6 is required to control light emitted from the LED 2 so as to conform to this and other light distribution standards. However, it may be hard to select the LED 2 such that it has a large amount of light-emission and conforms to light distribution standards and also maintains a predetermined individual brightness in a predetermined light distribution pattern. The above-described problems and characteristics may be present not only in the LED 2 light source but also in other light-emitting semiconductor devices.

The disclosed subject matter has been devised to consider the above and other problems, features, and characteristics. Thus, an embodiment of the disclosed subject matter can include a vehicle lamp using a light-emitting semiconductor device as a light source with a favorable light distribution pattern and a vehicle lamp using a light-emitting semiconductor device as a light source with a simple structure and a high visibility, even if a person recognizing the vehicle is outside of an area of a light distribution standard and a driver of the vehicle sees a position beyond an area of a light distribution standard. In addition, the structure for the vehicle lamp in accordance with principles of the disclosed subject matter allows the vehicle lamp to form various futuristic novel and appealing outside appearances and design.

SUMMARY OF THE DISCLOSED SUBJECT MATTER

The presently disclosed subject matter has been devised in view of the above and other characteristics, desires, and problems in the conventional art, and to make certain changes to the existing structure of a vehicle lamp using a light-emitting semiconductor device as a light source. An aspect of the disclosed subject matter includes providing vehicle lamps using a light-emitting semiconductor device with a favorable light distribution pattern. Another aspect of the disclosed subject matter includes providing vehicle lamps using a light-emitting semiconductor device that can accommodate various variations thereof and can expand possibilities for different design.

According to an aspect of the disclosed subject matter, a vehicle lamp can include: at least one light-emitting semiconductor device; and at least one lens including both a first lens formation and a second lens formation, an optical axis of the at least one lens corresponding with an optical axis of the at least one light-emitting semiconductor device, wherein the first lens formation focuses a light that is within the range of a half-value angle in a light emitted from the at least one light-emitting semiconductor and the second lens formation diffuses a light that is beyond the range of the half-value angle in a light emitted from the at least one light-emitting semiconductor.

In the above-described exemplary vehicle lamp, the first lens formation can form a predetermined light distribution pattern. The second lens formation can form a light distribution pattern in an area out of the light distribution pattern formed by the first lens formation. In addition, the second lens formation can also include a number of convex micro-geometry having the respective opposite phases between an incoming surface of light and an outgoing surface of light.

According to the above-described aspect of the disclosed subject matter, because the first lens formation can focus a strong light that is within the range of a half-value angle of light emitted from the at least one LED and can illuminate the light forwards, the first lens formation of the vehicle lamp can form a predetermined light distribution patter, for example, a light distribution pattern to conform to a light distribution standard in accordance with a traffic law.

In addition, because the second lens formation can diffuse a weak light that is beyond the range of a half-value angle for light emitted from the at least one LED and can illuminate the light forwards, the second lens formation of the vehicle lamp can form a light distribution pattern in an area out of the light distribution pattern formed by the first lens formation. Thus, even if a person recognizing the vehicle is out of an area of a standard light distribution pattern, and also when a driver of the vehicle sees a position beyond an area of a standard light distribution pattern, the vehicle lamp can maintain high visibility.

Furthermore, because each of the front micro-geometry and the rear micro-geometry in the second lens formation can include respective opposite phases, the brightness of the vehicle lamp can differ according to an angle at which the second lens formation is viewed. Therefore, when a person moving in a sideward direction relative to the vehicle sees the vehicle lamp, that person will see the light of the vehicle lamp as if it is moving. Thus, the vehicle lamp of the disclosed subject matter can result in high visibility thereof and can provide a new outside appearance with ingenuity and opportunities for further design.

According to another aspect of the disclosed subject matter, the above-described vehicle lamp can include: at least one reflector located between the at least one light-emitting semiconductor device and the at least one lens, wherein the optical axis of the at least one light-emitting semiconductor device corresponds to the optical axis of the at least one lens by changing a light path thereof through the at least one reflector.

According to this aspect of the disclosed subject matter, the optical axis of the at least one light-emitting semiconductor can be located on the optical axis of the at least lens so as to correspond with the respective optical axes. However, in the immediately above-described exemplary vehicle lamp, the optical axis of the at least one light-emitting semiconductor device can be voluntarily or selectively located by corresponding the axis with the optical axis of the at least one lens using the at least one reflector. Thus, the design possibilities for the vehicle lamp can be expanded.

In the above-described exemplary vehicle lamps, the first lens formation can include a plurality of collecting lenses. Thus, the vehicle lamp of the disclosed subject matter can accommodate various light distribution patterns using the plurality of collecting lens in the first lens formation. Therefore, the vehicle lamps can also conform to a particular light distribution standard in accordance with traffic laws.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
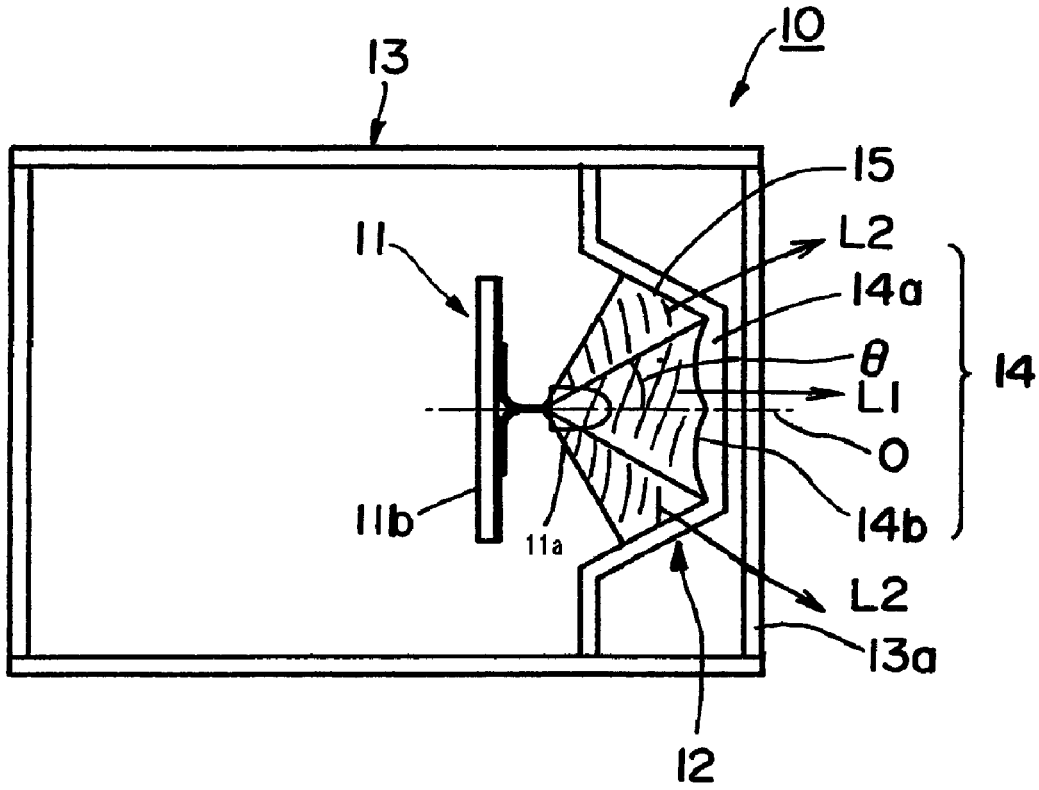
FIG. 1 is a schematic cross-section view showing a first exemplary embodiment of a vehicle lamp made in accordance with principles of the disclosed subject matter.

The disclosed subject matter will now be described in detail with reference to FIGS. 1 to 7. FIG. 1 is a schematic cross-section view showing a first exemplary embodiment of a vehicle lamp made in accordance with principles of the disclosed subject matter. A vehicle headlight 10 shown in FIG. 1 is composed of a light source 11 including at least one LED 11*a*, a lens 12 located in front of the light source 11, and a casing 13.

The light source 11 can be composed of the at least one LED 11*a*, which can be mounted on a circuit board 11*b* so that an optical axis thereof is perpendicular to the circuit board 11*b*. The at least one LED 11*a* can be caused to emit light by a driving circuit implemented on the circuit board 11*b* or by a driving circuit implemented on an outside circuit board via the circuit board 11*b*.

Figure 2A:
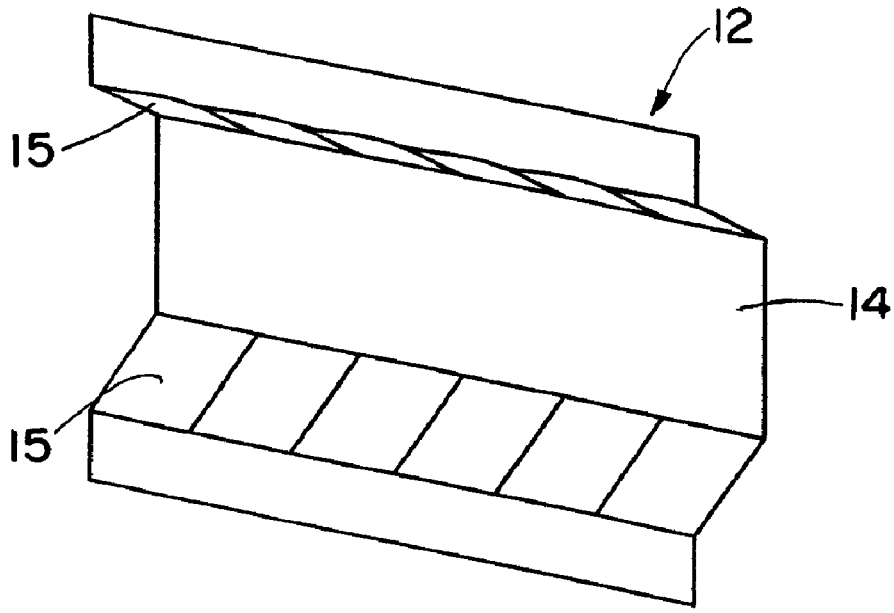
FIGS. 2(A) and (B) are respective schematic perspective views of a rear and front showing a lens of the vehicle lamp shown in FIG. 1.
Figure 2B:
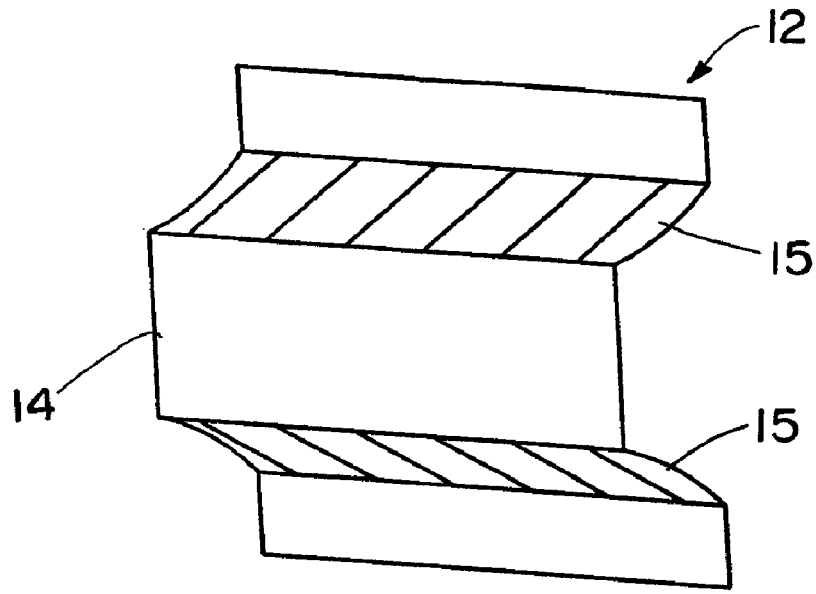

The lens 12 can be composed of a transparent material such as a transparent resin and the like. The lens 12 can be located perpendicular to the optical axis of the at least one LED 11*a* so that an optical axis of the lens 12 corresponds with that of the at least one LED 11*a*. FIGS. 2(A) and (B) are respective schematic perspective views of a rear and front of the lens 12. The lens 12 can include both a first lens formation 14 and a second lens formation 15 provided on the top and bottom of the first lens formation 14 as shown in FIG. 2.

The first lens formation 14 can be located in a large part thereof within the range of a half-value angle of the at least one LED 11*a* to the optical axis of the at least one LED 11*a* as shown in FIG. 1. Thus, the first lens formation 14 can receive a strong light that is within the range of a half-value angle in a light emitted from the at least one LED 11*a* and can focus the strong light, and can illuminate the strong light forwards in a direction towards of light-emission (a rightward direction in FIG. 1) in order to form a predetermined light distribution pattern, for example a light distribution pattern, to conform to a light distribution standard in accordance with a traffic law.

It should be noted that a half-value angle of light emitted from the at least one light-emitting semiconductor can be considered to be that angle at which light intensity decreases by more than half of the optimum light intensity for the LED.

On the other hand, the second lens formation 15 can be located in large part thereof beyond the range of the half-value angle of the at least one LED 11*a* with respect to the optical axis of the at least one LED 11*a* as shown in FIG. 1. Thus, the second lens formation 15 can receive weak diffuse light that is out of the range of a half-value angle of the light emitted from the at least one LED 11*a* and can diffuse the weak light therein. The second lens formation 15 can illuminate the weak light forwards in a direction towards light-emission for the lamp in order to form a light distribution pattern with a long wide angle range.

Figure 3A:
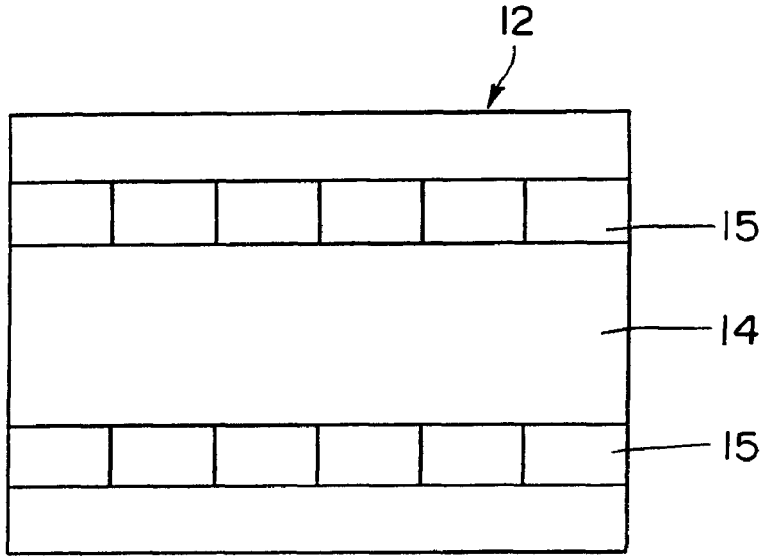
FIGS. 3(A) and (B) are respectively a front view and a side cross-section view of the lens in the vehicle lamp shown in FIG. 1.
Figure 3B:
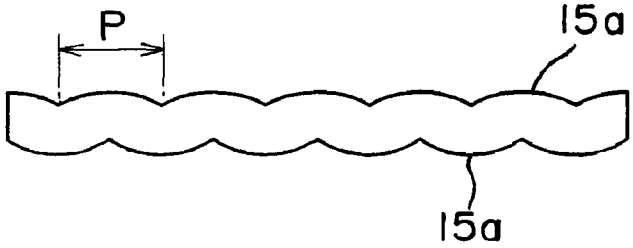

More specifically, FIGS. 3(A) and (B) are respectively a front view and a side cross-section view of the lens 12. As shown in FIG. 3(B), the second lens formation 15 can be composed of a number of convex micro-geometry formations 15*a* formed in a side direction on both surfaces of an incoming surface of light and an outgoing surface of light.

Figure 4:
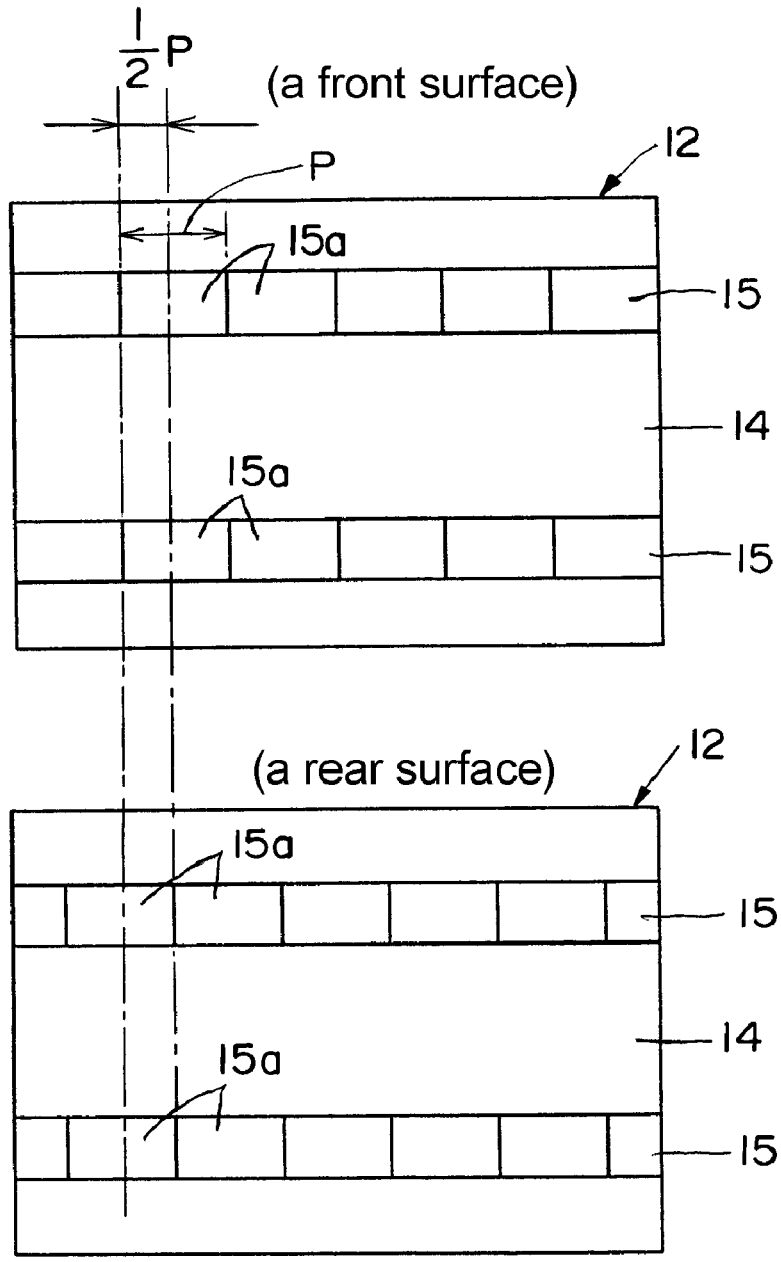
FIG. 4 is an explanatory drawing depicting a phase lag of micro-geometry between a front surface and a rear surface of the lens shown in FIG. 3.

FIG. 4 is an explanation drawing depicting a phase lag of micro-geometry formations between a front surface (an outgoing surface of light) and a rear surface (an incoming surface of light) in the lens 12 shown in FIGS. 1 to 3. The convex micro-geometry formations 15*a* can regularly align at a predetermined interval P, and the phase lag of the micro-geometry formations between the front surface and the rear surface can be a half of interval P as shown in FIG. 4. That is to say, each phase of the front micro-geometry formations 15*a* and the rear micro-geometry formations 15*a* can be opposite to each other.

The above-described casing 13 can fix both the light source 11 and the lens 12 including both the first lens formation 14 and the second lens formation 15 and can cover both the light source 11 and the lens 12 in order to effectively provide illumination from light emitted from the light source 11. Thus, the casing 13 can include a transparent cover 13*a* in front of the lens 12, which can laconically illuminate the above-described light as shown in FIG. 1.

Figure 5:
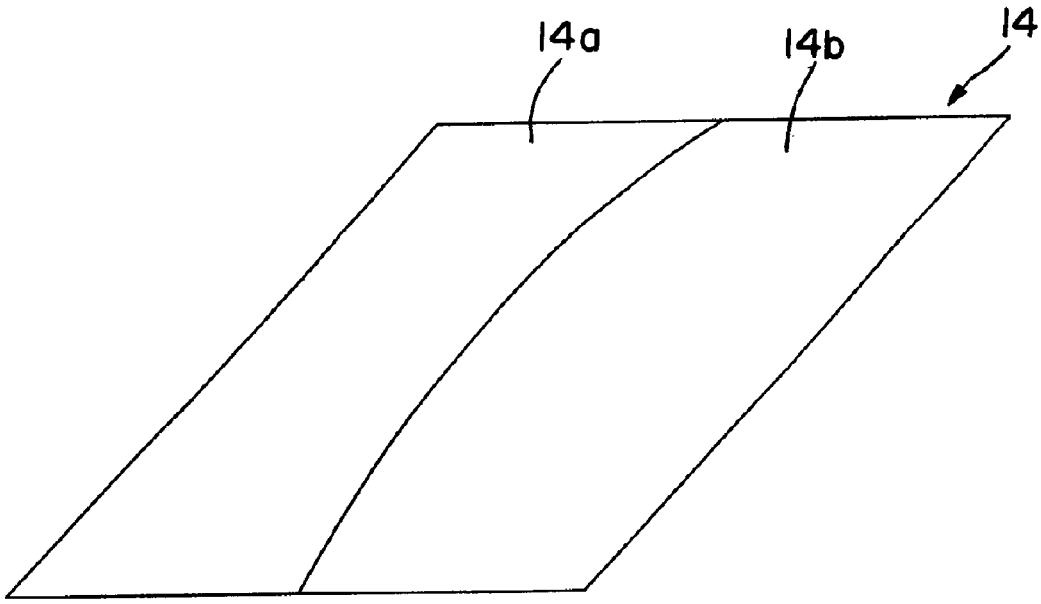
FIG. 5 is an enlarged perspective view showing a first lens formation of the lens shown in FIG. 3.

The exemplary vehicle lamp 10 made in accordance with principles of the disclosed subject matter can be configured as described above. More specific description of the exemplary lens 12 will now be given. The first lens formation 14 of the lens 12 can include a plurality of collecting lenses 14*a*. FIG. 5 is an enlarged perspective view showing the first lens formation 14 of the lens 12 shown in FIGS. 1 to 4. The first lens formation 14 can be composed of collecting lenses 14*a*, 14*b* divided between a top and bottom side to the optical axis of the at least one LED 11*a*.

Each of the collecting lenses 14*a*, 14*b* on the top and bottom side can form a landscape-oriented convex lens. Therefore, the first lens formation 14 can focus strong light from the light emitted from the at least one LED 11*a* horizontally long near a central portion towards the optical axis thereof. Thus, the first lens formation 14 can form a predetermined light distribution pattern (a principle light distribution), for example, a light distribution pattern to conform to a light distribution standard using the plurality of collecting lenses 14*a*.

In this case, because the first lens formation 14 can receive strong light L1 that is within the range of a half-value angle in the light emitted from the at least one LED 11*a* as shown in FIG. 1, the first lens formation 14 can focus the strong light L1 near a central portion towards the optical axis thereof using an optical operation thereof. Thus, the strong light L1 can be illuminated forward in a direction towards light-emission and horizontally long along with a predetermined light distribution characteristic and therefore can form a predetermined light distribution pattern (a principle light distribution) to conform with a light distribution standard in accordance with a traffic law.

Figure 6:
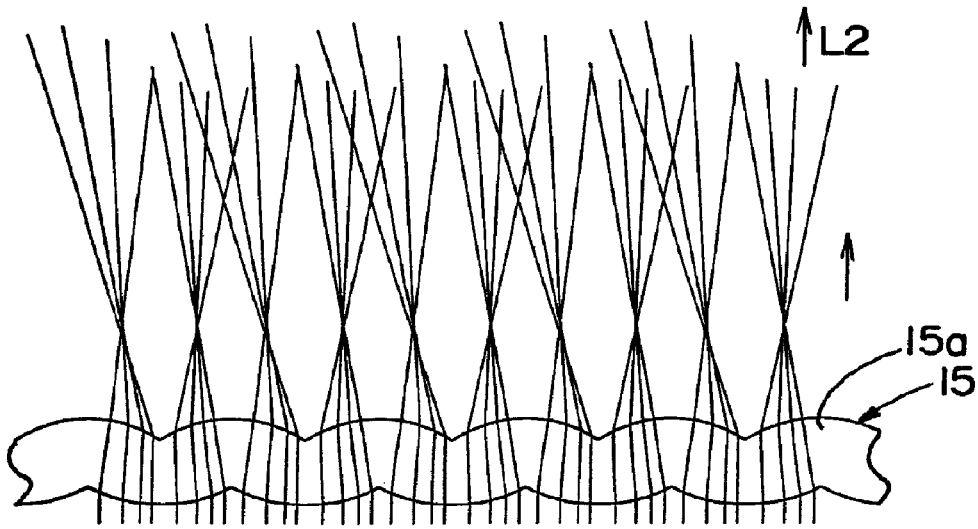
FIG. 6 is a partial enlarged cross-section view showing a diffused inflection of light in a second lens formation when the vehicle lamp shown in FIG. 1 is operated.

On the contrary, FIG. 6 is a partial enlarged cross-section view showing a diffused inflection of light in the second lens formation 15. The second lens formation 15 can diffuse a comparatively weak light from the light emitted from the at least one LED 11*a* in both directions towards the left and right using a diffused inflecting operation thereof. Thus, the second lens formation 15 can form a light distribution pattern diffusing light in both side directions with a long wide range so as not to include a glare type of light in the light emitted from the lamp.

In this case, because the second lens formation 15 can receive a comparatively weak light L2 that is beyond the range of a half-value angle of light emitted from the at least one LED 11*a* as shown in FIG. 1, the second lens formation can diffuse the weak light L2 in both directions towards the left and right without including a glare light in accordance with an optical operation thereof as shown in FIG. 6. Thus, the weak light L2 can be illuminated forward with a wide range characteristic diffusing in both directions towards the left and right and therefore can form a long wide light distribution pattern (an auxiliary light distribution).

In consequence, even when a driver of the vehicle employing the vehicle lamp 10 attempts to view a position beyond a light distribution pattern (a principle light distribution) formed by the light L1, the driver can make sure of the position with an auxiliary light distribution formed by the light L2. In addition, even if a person is out of an area of a light distribution pattern formed by the light L1, the person can recognize the vehicle employing the vehicle lamp 10 because of the auxiliary light distribution formed by the light L2. Thus, the vehicle lamp 10 can improve safety with high visibility even when persons viewing or things being viewed are in a position beyond or outside that of a principle light distribution.

In addition, when each phase of the front micro-geometry formations 15*a* and the rear micro-geometry formations 15*a* in the second lens formation 15 of the lens 12 can be opposite to each other, the light L2 passing via the second lens formation 15 can be diffused with more confidence, and a brightness of the light L2 can differ according to an angle at which the second lens formation 15 is viewed. Thus, when a person moving in a side direction of the vehicle which employs the vehicle lamp 10 views the vehicle, the person can see the light L2 as if it moves due to a variant brightness. Thus, the vehicle lamp 10 including both the front micro-geometry formations 15*a* and the rear micro-geometry formations 15*a* can realize a higher visibility and a novel outside appearance thereof.

As described above, according to the vehicle lamp 10 of the first exemplary embodiment in accordance with the disclosed subject matter, the at least one LED 11*a* of the light source 11 can be caused to emit by a driving circuit. Light emitted from the at least one LED 11*a* can be illuminated forward in a direction of light-emission via the lens 12, which can include both the first lens formation 14 configured to have a gathering operation and the second lens formation 15 configured to have a diffusing operation.

Thus, because the first lens formation 14 can form a predetermined light distribution pattern as a principle light distribution pattern and the second lens formation 15 can form an auxiliary light distribution in the area outside of the predetermined light distribution pattern formed by the first lens formation 14, the vehicle lamp 10 can improve both light distribution and visibility. Furthermore, various variations in shape of the second lens formation 15 can result in a new outside appearance with ingenuity in design option possibilities regarding the vehicle lamp 10.

Figure 7:
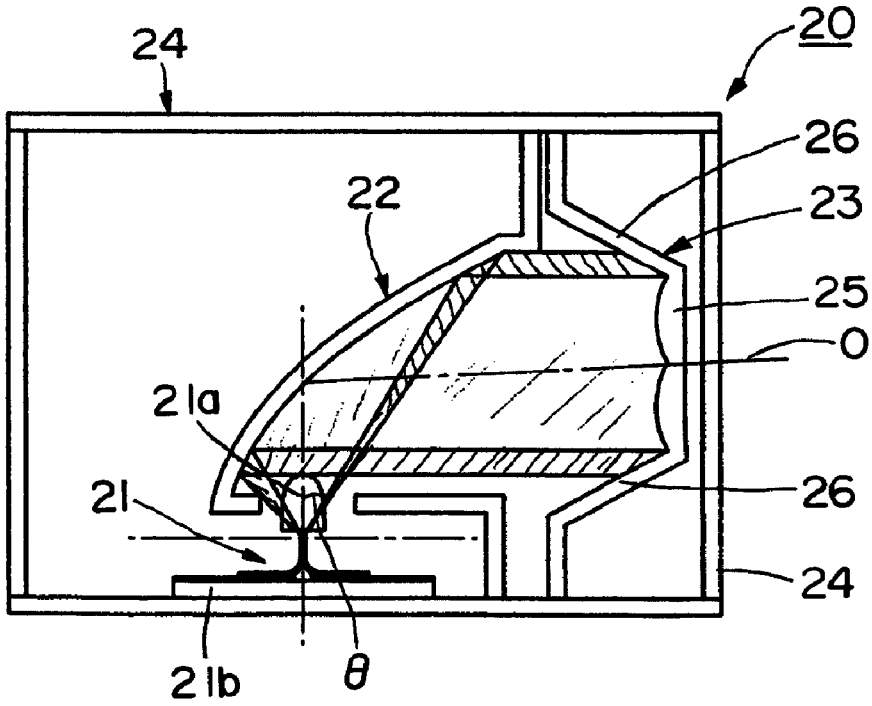
FIG. 7 is a schematic cross-section view showing a second exemplary embodiment of a vehicle lamp made in accordance with principles of the disclosed subject matter.
Figure 8:
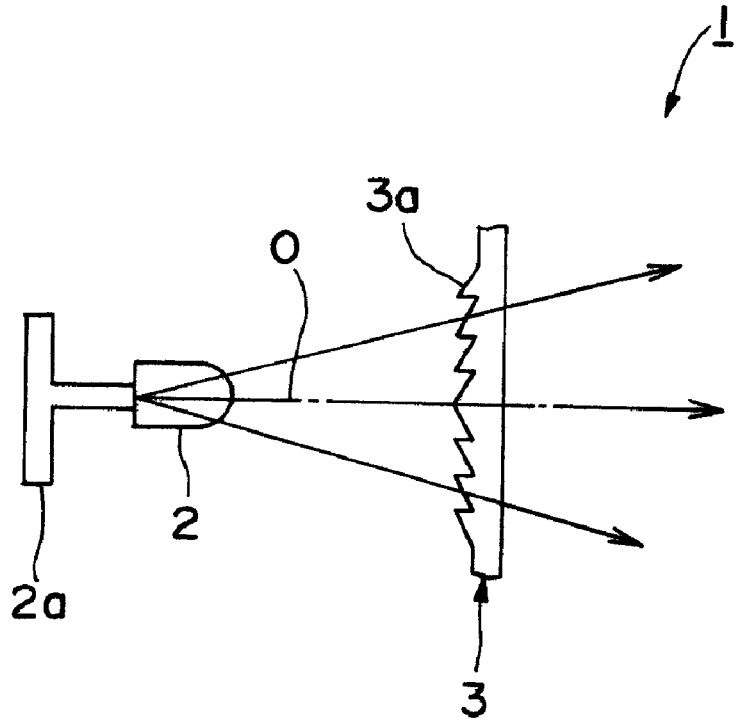
Fig.8 Conventional Art
FIG. 8 is a schematic cross-section view showing a first exemplary structure of a conventional vehicle lamp using an LED.
Figure 9:
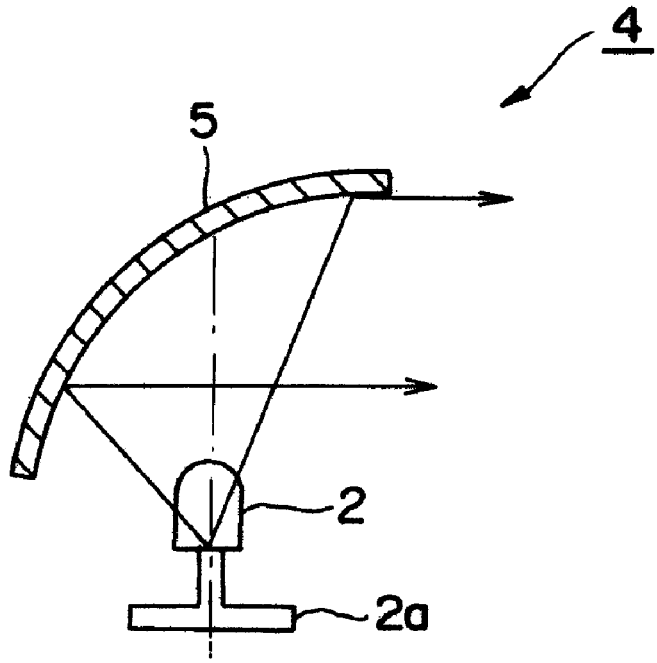
Fig.9 Conventional Art
FIG. 9 is a schematic cross-section view showing a second exemplary structure of a conventional vehicle lamp using an LED.

A second exemplary embodiment of the disclosed subject matter will now be described in detail with reference to FIG. 7. FIG. 7 is a schematic cross-section view showing a second exemplary embodiment of a vehicle lamp made in accordance with principles of the disclosed subject matter. A vehicle lamp 20 can be composed of a light source 21 including at least one LED 21*a*, a reflector 22 located so as to cover the light source 21 from a direction towards light-emission of the at least one LED 21*a*, a lens 23 located in front of the reflector 22, and a casing 24.

The light source 21 can include the at least one LED 21*a*, which can be mounted on a circuit board 21*b* so that an optical axis thereof is perpendicular to the circuit board 21*b* similar to the vehicle lamp 10 shown in FIG. 1. However, the light source 21 can be different from the light source 11 with respect to a direction of the circuit board 21*b*, which can be positioned horizontally so that the optical axis of the at least one LED 21*a* mounted thereon extends upwards.

The reflector 22 can be formed concave in a forward direction and can include an inner reflex reflector thereon in order to reflex a light emitted from the at least one LED 21*a* in the forward direction (a rightward direction in FIG. 7). Thus, the reflector 22 can change a light path of the at least one LED 21 in the forward direction using the inner reflex reflector.

More specifically, the inner reflex reflector can be composed of a parabolic reflector, for instance, a parabolic surface revolving around an optical axis O of the lens 23 extending in a direction towards the light-emission of the vehicle lamp 20. A focus of the inner reflex reflector can be located near a light-emitting portion of the at least one LED 21*a*. Thus, a light emitted from the at least one LED 21*a* can reflect on the inner reflex reflector and can travel forward in a direction of light-emission for the vehicle lamp 20 and as a parallel light.

Figure 10:
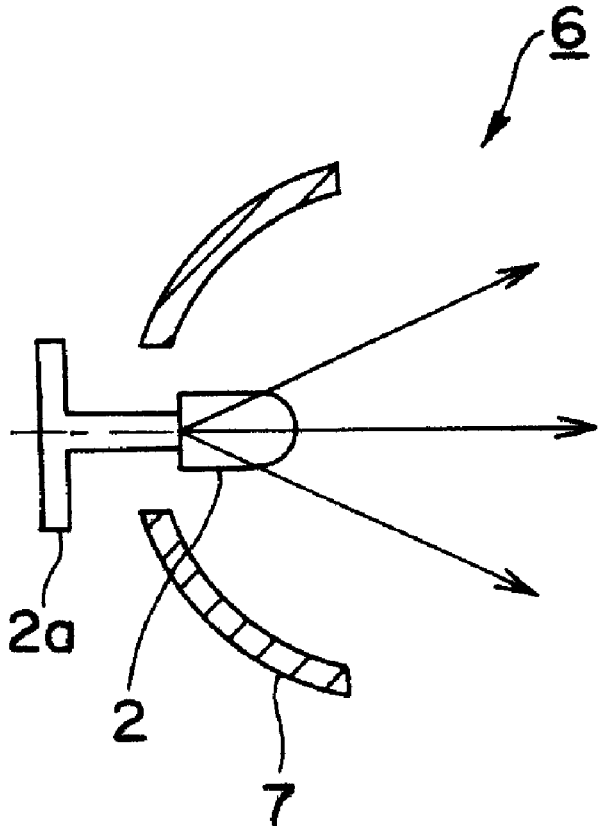
Fig.10 Conventional Art
FIG. 10 is a schematic cross-section view showing a third exemplary structure of a conventional vehicle lamp using an LED.

The lens 23 can be composed of a transparent material such as a transparent resin and the like, and can be located substantially perpendicular to the optical axis of the at least one LED 21*a*. The lens 23 can include both a first lens formation 25 and a second lens formation 26 similar to the lens 12 in the vehicle lamp 10 shown in FIG. 10. In this case, the first lens formation 25 can be composed of the same structural characteristics as described with respect to the first lens formation 14 of the lens 12 in the vehicle lamp 10 shown in FIG. 1, and can be located near the optical axis of the lens 23.

The second lens formation 26 can also be composed of the same structural characteristics as the second lens formation 15 of the lens 12 in the vehicle lamp 10 shown in FIG. 1 and can also be located on a top and bottom of the first lens formation 25. Therefore, the second lens formation 26 can include a number of convex micro-geometry formations formed in a side direction on both surfaces of an incoming surface of light and an outgoing surface of light.

However, the optical axis of the lens 23 does not directly correspond with the optical axis of the at least one LED 21*a* as in the vehicle lamp 10 shown in FIG. 1. That is to say, the optical axis of the lens 23 can correspond with that of the at least one LED 21*a* by changing a light path of the at least one LED 21*a* using the reflector 22. An angle changing a light path of the at least one LED 21*a* can be approximately ninety degrees in the vehicle lamp 20 shown in FIG. 7. However, the angle is not limited so long as the optical axis of the lens 23 can be caused to correspond with that of the at least one LED 21*a*.

Thus, because the first lens formation 25 can receive a strong light that is within the range of a half-value angle of light emitted from the at least one LED 21*a* along the optical axis of the at least one LED 21*a* via the reflector 22, the first lens formation 25 can focus a comparatively strong light emitted from the at least one LED 21*a* and can illuminate it forward in a direction of light-emission (a rightward direction in FIG. 7). Therefore, the first lens formation 25 can form a predetermined light distribution pattern such as a light distribution pattern that can conform to a light distribution standard in accordance with a traffic law.

On the other hand, because the second lens formation 26 can receive a comparatively weak light that is out of the range of a half-value angle to the optical axis of the at least one LED 21*a* of light emitted from the at least one LED 21*a* via the reflector 22, the second lens formation 26 can diffuse the weak light in both directions towards a left and right and can illuminate forward in a direction of light-emission without including a glare light. Thus, the vehicle lamp 20 can form a light distribution pattern with a wide angle range.

According to the vehicle lamp 20 of the above-described structure, the vehicle lamp 20 can operate as same as the vehicle lamp 10 shown in FIG. 1. That is to say, a light emitted from each of the at least one LED 21*a* of the light source 21 can reflect on the reflector 22 and can pass as a substantially parallel light through the lens 23, and can be illuminated forward in a direction of light-emission for the vehicle lamp 20.

In this case, after a light L1 that is within the range of a half-value angle with respect to the optical axis for light emitted from the at least one LED 21*a* reflects on the reflector 22, the light L1 can enter the first lens formation 25 of the lens 23. The first lens formation 25 can focus the light L1 near a central portion towards the optical axis of the lens 23 in accordance with an optical operation thereof. Thus, the first lens formation 25 can illuminate the light L1 forward along with a predetermined light distribution characteristic and therefore can form a predetermined light distribution pattern (a principal light distribution) to conform with a light distribution standard in accordance with a traffic law.

On the other hand, after a light L2 that is out of the range of a half-value angle with respect to the optical axis of light emitted from the at least one LED 21*a* can reflect on the reflector 22, the light L2 can enter the second lens formation 26 of the lens 23. The second lens formation 26 can diffuse the light L2 in both directions towards the left and right along with a diffusing inflection in accordance with an optical operation thereof. Thus, the second lens formation 26 can illuminate the light L2 forward with a long wide range characteristic, diffusing in both directions left and right, and therefore can form a long wide light distribution pattern (an auxiliary light distribution).

Thus, even if a driver of the vehicle employing the vehicle lamp 20 views a position beyond a light distribution pattern (a principle light distribution) formed by the light L1, the driver can accurately view the position with an auxiliary light distribution formed by the light L2*a*. In addition, even if a person who is attempting to recognize the vehicle which employs the vehicle lamp 20 is out of an area of a light distribution pattern formed by the light L1, the person can accurately view the vehicle with an auxiliary light distribution formed by the light L2. Thus, the vehicle lamp 20 can improve safety with high visibility even in a position outside of an area of a principle light distribution.

In the above-described exemplary embodiments, one LED is shown as a light-emitting semiconductor device composing the light sources 11 and 21 of FIGS. 1 and 7. However, two or more LEDs can be used for the light sources 11 and 21, and a plurality of light sources can also be employed. In the case when using a plurality of light sources, each of the light sources can be include the respective first lens formations and the respective second lens formations. In this case, the vehicle lamp 10 and 20 using a plurality of light sources can expand a possibility of performance advances. In addition, a light-emitting semiconductor device cannot be limited to an LED. Other light-emitting semiconductors can be used, such as a laser, etc.

In the vehicle lamp 10 of the first exemplary embodiment, the optical axis of the at least one LED 11*a* corresponds directly with that of the lens 12. Thus, it may be difficult for the vehicle lamp 10 to provide a large light-emitting area and a thin casing. However, because the vehicle lamp 20 of the second exemplary embodiment can change the light path for the LED, the vehicle lamp 20 allows for a large and thin light-emitting area. In addition, because the angle changing a light path for the light-emitting semiconductor device and the number of light sources is not limited, a vehicle lamp 20 having various performances and outside appearances can be designed.

As described above, the disclosed subject matter can provide a vehicle lamp using a light-emitting semiconductor device with a simple structure and providing high visibility even in a position beyond an area of a standard light distribution pattern. Furthermore, the vehicle lamp using the above-described structure can also result in a futuristic outside appearance or other design characteristics. Various modifications of the above disclosed embodiments can be made without departing from the spirit and scope of the presently disclosed subject matter.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A vehicle signal lamp, comprising:

at least one LED; and at least one lens including a first lens formation and a second lens formation, the first lens formation configured with at least one landscape-oriented convex surface facing the at least one LED so that light emitted from the at least one LED is focused horizontally long, the second lens formation located adjacent the first lens formation and configured with a number of convex micro-geometry formations that are located on an incoming surface and an opposed outgoing surface of the second lens formation, the number of convex micro-geometry formations of the second lens formation extending in a longitudinal direction of the at least one landscape-oriented convex surface of the first lens formation, and an optical axis of the at least one lens corresponding with an optical axis of the at least one LED, wherein the first lens formation is located in a path and focuses a light that is within a range of a half-value angle of the light emitted from the at least one LED, and the second lens formation is located in a path and diffuses light that is outside of the range of the half-value angle of the light emitted from the at least one LED.

2. The vehicle signal lamp according to claim 1, wherein the first lens formation is configured to form a predetermined light distribution pattern.

3. The vehicle signal lamp according to claim 2, wherein the second lens formation is configured to form a light distribution pattern in an area outside of the predetermined light distribution pattern formed by the first lens formation.

4. The vehicle signal lamp according to claim 3, wherein the convex micro-geometry formations have respective opposite phases between the incoming surface of the second lens formation and the opposed outgoing surface of the second lens formation.

5. The vehicle signal lamp according to claim 4, further comprising:

at least one reflector located between the at least one LED and the at least one lens, wherein light emitted from the at least one LED is directed along a light path that corresponds with the optical axis of the at least one lens at a position after the light path is changed by the at least one reflector.

6. The vehicle signal lamp according to claim 3, further comprising:

at least one reflector located between the at least one LED and the at least one lens, wherein light emitted from the at least one LED is directed along a light path is changed by the at least one reflector.

7. The vehicle signal lamp according to claim 3, wherein the first lens formation includes a plurality of collecting lenses.

8. The vehicle signal lamp according to claim 2, wherein the convex micro-geometry formations have respective opposite phases between the incoming surface of the second lens formation and the opposed outgoing surface of the second lens formation.

9. The vehicle signal lamp according to claim 8, further comprising:

at least one reflector located between the at least one LED and the at least one lens, wherein light emitted from the at least one LED is directed along a light path that corresponds with the optical axis of the at least one lens at a position after the light path is changed by the at least one reflector.

10. The vehicle signal lamp according to claim 2, further comprising:

at least one reflector located between the at least one LED and the at least one lens, wherein light emitted from the at least one LED is directed along a light path that corresponds with the optical axis of the at least one lens at a position after the light path is changed by the at least one reflector.

11. The vehicle signal lamp according to claim 2, wherein the first lens formation includes a plurality of collecting lenses.

12. The vehicle signal lamp according to claim 1, wherein the second lens formation is configured to form a light distribution pattern in an area outside of a light distribution pattern formed by the first lens formation.

13. The vehicle signal lamp according to claim 12, wherein the convex micro-geometry formations have respective opposite phases between the incoming surface of the second lens formation and the opposed outgoing surface of the second lens formation.

14. The vehicle signal lamp according to claim 13, further comprising:

at least one reflector located between the at least one LED and the at least one lens, wherein light emitted from the at least one LED is directed along a light path that corresponds with the optical axis of the at least one lens at a position after the light path is changed by the at least one reflector.

15. The vehicle signal lamp according to claim 12, further comprising:

at least one reflector located between the at least one LED and the at least one lens, wherein light emitted from the at least one LED is directed along a light path that corresponds with the optical axis of the at least one lens at a position after the light path is changed by the at least one reflector.

16. The vehicle signal lamp according to claim 12, wherein the first lens formation includes a plurality of collecting lenses.

17. The vehicle signal lamp according to claim 1, wherein the convex micro-geometry formations have respective opposite phases between the incoming surface of the second lens formation and the opposed outgoing surface of the second lens formation.

18. The vehicle signal lamp according to claim 17, further comprising:

at least one reflector located between the at least one LED and the at least one lens, wherein light emitted from the at least one LED is directed along a light path that corresponds with the optical axis of the at least one lens at a position after the light path is changed by the at least one reflector.

19. The vehicle signal lamp according to claim 1, further comprising:

at least one reflector located between the at least one LED and the at least one lens, wherein light emitted from the at least one LED is directed along a light path that corresponds with the optical axis of the at least one lens at a position after the light path is changed by the at least one reflector.

20. The vehicle signal lamp according to claim 1, wherein the first lens formation includes a plurality of collecting lenses.

21. The vehicle signal lamp according to claim 1, wherein the first lens formation is substantially rectangular in shape having two long sides and two short sides, and the second lens formation is located above and below the first lens formation and extends along the two long sides of the first lens formation.

22. The vehicle signal lamp according to claim 21, wherein the second lens formation includes a top portion separated from and spaced from a bottom portion by the first lens formation.

23. The vehicle signal lamp according to claim 22, wherein a plane containing the top portion of the second lens formation extends at an angle between 30 and 60 degrees with respect to a plane containing the first lens formation, and a plane containing the bottom portion of the second lens formation extends at an angle between 30 and 60 degrees with respect to a plane containing the first lens formation.

* * * * *